US010710680B2

(12) United States Patent
Onweller

(10) Patent No.: US 10,710,680 B2
(45) **Date of Patent: *Jul. 14, 2020**

(54) MARINE MOORING LINE VERMIN SHIELD

(71) Applicant: Arthur E. Onweller, Evergreen, CO (US)

(72) Inventor: Arthur E. Onweller, Evergreen, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/179,890

(22) Filed: Nov. 3, 2018

(65) Prior Publication Data

US 2020/0140041 A1 May 7, 2020

(51) Int. Cl.
*B63B 21/12* (2006.01)

(52) U.S. Cl.
CPC ..... *B63B 21/12* (2013.01)

(58) Field of Classification Search
CPC ..... B63B 21/12
USPC ..... 114/221 R
See application file for complete search history.

(56) References Cited

U.S. PATENT DOCUMENTS 5,570,652 A * 11/1996 Ferland ..... B63B 21/12 114/221 R
6,450,113 B1 * 9/2002 Onweller ..... B63B 21/12 114/221 R
7,086,344 B2 * 8/2006 Onweller ..... B63B 21/12 114/221 R

* cited by examiner

*Primary Examiner* — Daniel V Venne
(74) *Attorney, Agent, or Firm* — Roger A. Jackson

(57) ABSTRACT

A marine mooring line vermin shield to prevent the passage of vermin crawling along a marine mooring line from land to a pleasure craft, including a disc with a centrally located aperture through the disc, and a slot extending from the aperture to a periphery of the disc. The vermin shield also includes a closure that is urged to insert into the disc slot in a closed state compressing the mooring line against the aperture to secure the vermin shield against the mooring line. The closure may also be locked in the closed state. The closure can also be extracted from the disc slot in an open state to allow the mooring line to be removed from the aperture through the slot past the disc periphery.

14 Claims, 12 Drawing Sheets

MARINE MOORING LINE VERMIN SHIELD

RELATED PATENT APPLICATIONS

There are no related patent applications.

TECHNICAL FIELD

The present invention generally relates to vermin control in a marine environment. More particularly, the present invention relates to preventing the passage of vermin crawling along a mooring line of a recreational pleasure craft from the shoreline and onto the pleasure craft.

BACKGROUND OF INVENTION

It has long been recognized in the prior art the problem of a vermin infestation of marine vessels who migrate from the shore line whether it is a dock, a marina, a beach, or any other means possible with the vermin crawling from land onto the marine vessel wherein the vermin are attracted to food, water, and an enclave for nesting in the hold of the marine vessel. Once the vermin are on the marine vessel numerous problems arise, such as sanitation issues with the food and water supply of the marine vessel and other safety issues wherein the vermin can chew on wiring insulation in the hold of the vessel potentially causing electrical short circuits and possibly fires. Trapping and catching vermin has proved difficult as they are nocturnal animals, and can move very swiftly, and have the ability to squeeze through a very small crevices and openings in the hold of the vessel that have difficult or limited access. Once the vermin have nested in the hold of the vessel it is typically required that the vessel be fumigated and then attempt to remove the dead vermin from the vessel. From the smallest to the largest vessels it is frequently very difficult even after fumigation to remove all of the dead vermin, which in time works to create unsanitary conditions from the decaying vermin carcasses.

As all marine vessels must of necessity be anchored or docked occasionally on either the beach or a dock where there is a mooring line that is strung between the cleats typically on the deck of the vessel and on the dock, or between the cleat on the deck of the vessel and an anchor that is on the shoreline. Even though the vessel is typically surrounded by least 6 ft. laterally of water, the vermin has ready access to the vessel by simply crawling along the mooring line from the dock or shoreline and onto the vessel itself. It has long been recognized in the prior art that the use of a shield barrier placed upon the mooring line to obstruct the vermin's ability to crawl along a mooring line and onto the ship is a solution to this problem.

Typical prior art solutions have included the use of a disc or a plurality of discs that are split in a semi circular fashion to be able to clamp upon the mooring line so that the disk assembly is secured in place upon the mooring line, as the mooring line is typically at an inclined angle with respect to the water level and the shoreline. A number of the prior art devices also include a vermin trap that sometimes has a poisonous substance inside wherein the vermin upon crawling up the mooring line and encountering the barrier are trapped inside the barrier and subsequently killed. U.S. Pat. No. 1,060,993 to Maynard and U.S. Pat. No. 4,890,416 to Roberts disclose this type of vermin guard. Other similar types of vermin guards do not have the vermin trap and poisonous substance, but are of a very similar design in other respects namely U.S. Pat. No. 1,401,540 to Konig, U.S. Pat. No. 1,486,417 to Cheely, U.S. Pat. No. 5,570,652 to Ferland, and U.S. Pat. No. 2,617,378 to Osol all utilize the aspect of only having a physical barrier to stop the vermin from migrating or crawling along the mooring line onto the vessel.

There are some more unique designs of vermin guards for vessels that attempt to overcome specific problems, one of which is when a vermin guard is used on a very large vessel such as a ship, gaining physical access to the mooring line can be difficult as the mooring line can be suspended much higher than a human's height above the water level. It is typically desired that the vermin guard be placed at an appreciable distance from the dock or shoreline, being at least 6 ft. or so to preclude the vermin from easily getting access to the mooring line on the vessel side of the barrier. Thus, some of the vermin guards have been designed to be installed on the mooring line remotely from the vessel deck. This is accomplished through the use of remote ropes or cables to the vermin guard to allow the mooring line clamping mechanism of the vermin guard to be opened and to then be clamped upon the mooring line by an individual on the vessel deck utilizing the attached ropes or cables. Examples would be U.S. Pat. No. 4,570,564 to Salvarezza.

U.S. Pat. No. 3,753,416 to Haglund et aI., U.S. Pat. No. 3,005,436 to Caldwell, and U.S. Pat. No. 2,525,234 to Mucke of which all disclose the ability to remotely mount and dismount the vermin guard from the mooring line. Salvarezza and Haglund et al., utilize a swinging door closure that clamps on the mooring line by virtue of gravity, Caldwell utilizes a resilient member to clamp on the mooring line, and Mucke utilizes a spring clamp to secure the vermin guard to the mooring line. One other type of vermin guard utilizes only a repellent type substance wrapped around a mooring line absent a physical barrier for the vermin crawling along is disclosed in U.S. Pat. No. 4,769,943 to Simpson.

The majority of the aforementioned prior art has been designed for use with large vessels with the possible exception of Roberts and Simpson who both utilize a poisonous substance to prevent the vermin from crawling along the mooring line to the vessel. As the use of a poisonous substance in conjunction with pleasure craft or recreational boating is not desirable due to the presence of children and various other reasons, there remains a need for vermin guard that is specifically designed for smaller recreational pleasure marine craft that utilizes a physical barrier only without the use of a poisonous substance to prevent vermin from crawling along and mooring line. The vermin guard for smaller craft should also be small, lightweight, easy to install, inexpensive to produce, and desirably float on the water if the vermin guard were inadvertently dropped into the water.

SUMMARY OF INVENTION

An object of the present invention is to prevent the passage of vermin crawling along a marine mooring line from the shoreline and onto the pleasure craft.

It is another object of the present invention is to provide for easy installation and removal of the marine mooring line vermin shield from the mooring line.

It is still another object of the present invention to provide for a locking mechanism to selectively secure the marine mooring line vermin shield to the mooring line to help prevent theft of the mooring line vermin shield.

It is further another object of the present invention to accommodate a plurality of mooring line diameters or sizes.

According to the present invention, then, a marine mooring line vermin shield is provided to prevent the passage of vermin crawling along a marine mooring line from land to a pleasure craft. Broadly, the present invention includes a disc having a disc axial axis perpendicular to a face of the disc, the disc axial axis being positioned in a central portion of the disc. The disc also includes an aperture through the disc coincident to the disc axial axis being positioned such that the aperture uses the disc axial axis as a centerline, with the aperture being sized and configured as a passage for the marine mooring line. The disc also includes a radial slot through the disc coincident to the disc axial axis, the radial slot extending from the aperture to a periphery of the disc, with the slot having a radial axis parallel to the slot.

In addition, the present invention includes a closure sized and adapted to insert into the slot in a closure pivotal movement arc approximately parallel to the disc axial axis. The closure is in a closed state when inserted into the slot and is substantially flush with the disc face, the closure is also sized and adapted to manually extract from the slot in the closure pivotal movement arc approximately parallel to the disc axial axis.

The closure is in an open state when extracted from the slot to allow the marine mooring line to pass through the slot from the periphery to the aperture. The closure also includes a first end that is substantially flush with the disc periphery when the closure is in the closed state, with the closure also including an opposing second end adapted to partially compress the mooring line against the aperture when the closure is in the closed state. Wherein the disc resists axial movement along the mooring line when the closure is in the closed state with the disc face generally perpendicular to a mooring line axial axis. Further included in the present invention is a means for urging the closure from the open state to the closed state.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
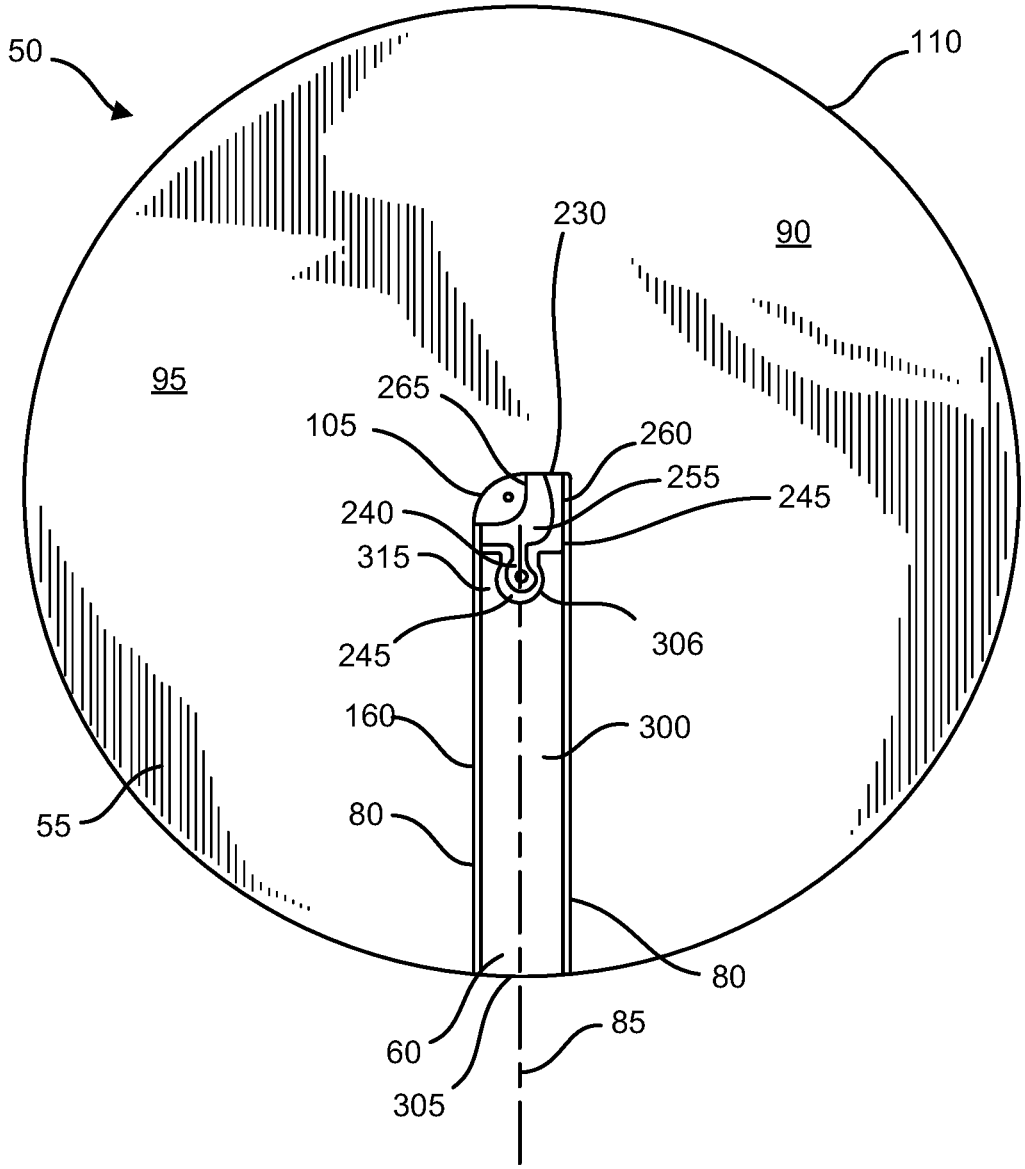
FIG. 1 shows a face front view of the marine mooring line vermin shield assembly with the closure including a removable aperture inserted into the disc slot, with the closure being in a closed state.

50 Marine mooring line vermin shield
55 Disc
60 Closure
65 Closure pivotal movement arc
70 Means for urging closure 60 form the open state to the closed state
75 Hinge pivot bolt rod
80 Slot opening in disc for mooring line
85 Slot opening radial axis in disc 55
90 Disc face
95 Placement area for pleasure craft registration number
100 Disc axial axis perpendicular to the disc face 90
105 Disc 55 aperture
110 Disc 55 periphery
115 Lock
120 Key
125 Key hole
130 Disc closure rest
135 Lock extension
140 Lock fastener
145 Pivotal axis between closure 60 and disc 55
150 First disc closure 60 clearance
155 Spring element
160 Second disc closure clearance
165 First closure rest
170 Closure clearance taper
175 Compression of marine mooring line
180 Marine mooring line axial axis
185 Marine mooring line
190 Axial movement along marine mooring line
195 Land including shoreline or dock or marina
200 Body of water
205 Pleasure craft
210 Pleasure craft cleat
215 Vermin
220 Dock cleat
225 Anchor
230 Aperture insert
231 Aperture insert 230 first surface

235 Aperture shoulder rest
240 Aperture retention screw protrusion preferably in the shape of a male keyhole
245 Aperture retention screw protrusion die clearance
246 Aperture disposed therethrough the protrusion 240
247 Neck of the protrusion 240
250 Aperture axial guide surface
255 Aperture insert face
260 Aperture shoulder
265 Aperture mooring line surface
270 Aperture face recess
275 Aperture void
280 Aperture mooring line surface radius axis
285 Aperture mooring line surface radius that can be different for differently sized mooring lines 185
290 Aperture mooring line surface radius intersection with axis
295 Closure shoulder stop
296 Closure retention void when assembled with aperture insert 230 guide surface 250
297 Closure axial guild surface or mooring line surface
300 Closure face
301 Closure surface
305 Closure first end
306 Closure fastener protrusion receiving void preferably in the shape of a female keyhole
307 Second aperture disposed therethrough the void 306 and the closure 60
310 Closure finger pull
315 Closure second end
320 Closure pivot mounts
325 Disc reinforcing ribs
330 Disc pivot mounts
335 Hinge pivot nut
336 Line of demarcation for the aperture insert 230 aperture retention screw protrusion 240 to closure fastener protrusion receiving void 306 all for a positional nesting and piloting fit up as between the aperture insert 230 and the closure second end 315
340 Line of demarcation for along axial axis 100 to set axial position from the aperture insert 230 shoulder rest 235 to contact the closure shoulder stop 295
345 Line of demarcation for slidable contact from the aperture insert axial guide surface 250 to the closure 60 axial guide surface 297
350 Fastener disposed through the protrusion 240 aperture 246 and the closure 60 second aperture 307

DETAILED DESCRIPTION

In FIG. 1, shown is a face 90 front view of the marine mooring line vermin shield assembly 50 with the closure 60 having a removable aperture insert 230 with the closure 60 inserted into the radial disc slot 80, with the closure 60 being in a closed state. More specifically, the marine mooring line vermin shield assembly 50 is shown in a face 90 front view from the side opposite of the closure 60 pivotal attachment to the disc 55 to clearly identify the face 90 side of the disc 55. The mooring line vermin shield assembly 50 is shown with the disc face 90, which is the side that the vermin (not shown) would encounter while crawling along the mooring line (not shown) from land. This is desired as this face 90 is a substantially smooth or flush and continuous surface with the exception of the mooring line protruding therefrom thus making it difficult for the vermin to gain any traction to climb up the disc face 90 to get around the vermin shield 50 and continue upon the mooring line toward the pleasure craft (not shown) when the closure 60 is in the closed state.

Figure 4:
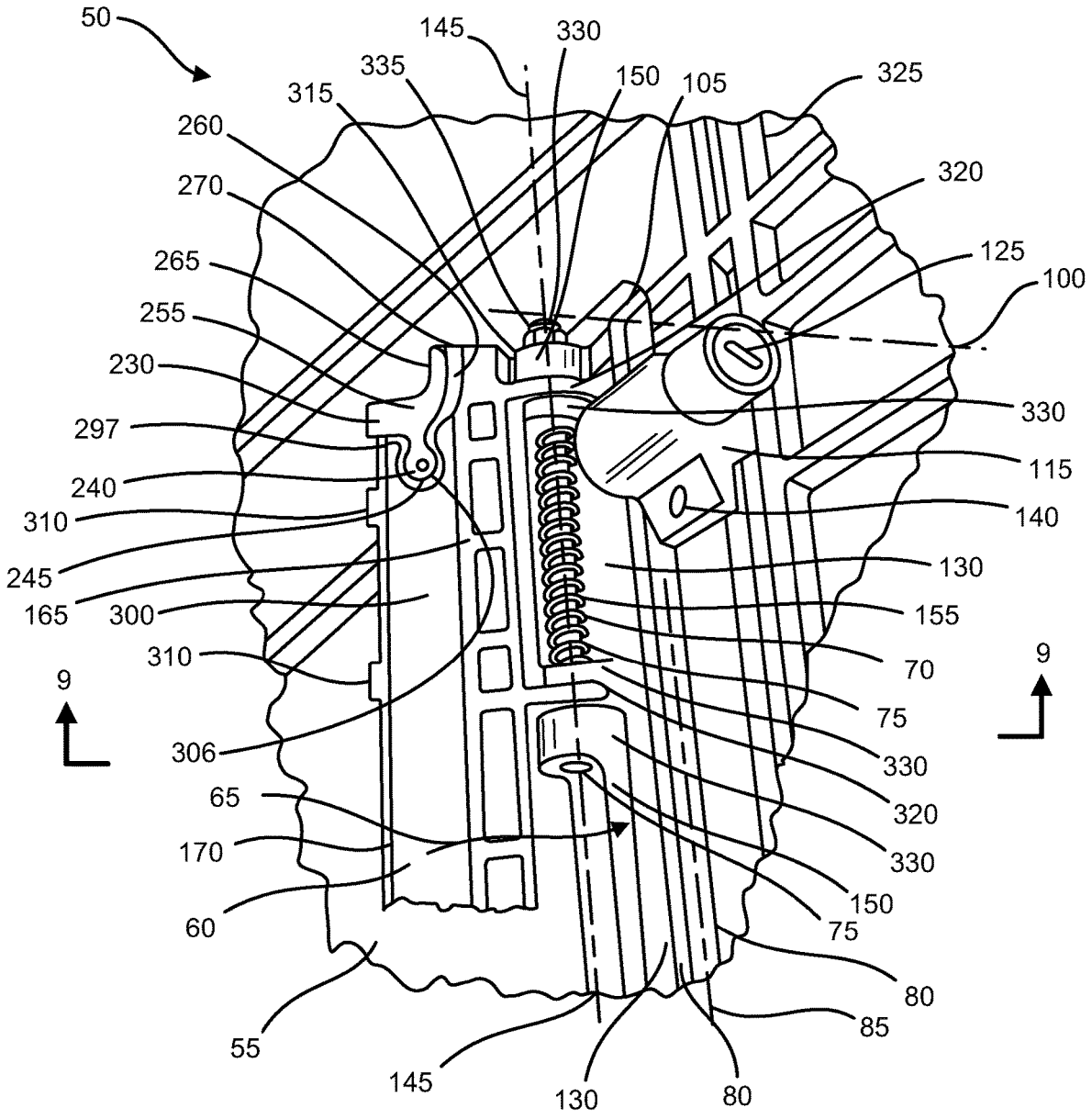
FIG. 4 shows a perspective view of the marine mooring line vermin shield assembly with the closure and the removable aperture extracted from the disc slot, resulting in the closure being in an unlocked and open state.

It is important to note that the closure 60, specifically the closure face 300, when in the closed state is substantially flush with the disc face 90 forming a continuous surface to effectively help block the vermin as previously described. In addition, the clearance gap between the closure 60 and the disc slot 80 is minimal to also prevent the vermin from overcoming the shield 50. The disc radial slot 80 through the disc 55 is coincident to the disc axial axis 100 (as shown in FIG. 4), with the radial slot 80 extending from the aperture 105 to a periphery 110 of the disc 55, the slot 80 has a radial axis 85 parallel to the slot 80. A mooring line passageway is formed by the disc aperture 105 and the aperture mooring line surface 265 of the aperture insert 230 or the closure mooring line surface 297, being a portion of the closure second end 315 as shown, if the aperture insert 230 is required depending upon the mooring line size as will be shown in FIG. 10 and FIG. 11. In other words, either the aperture mooring line surface 265 or as required for mooring line size the closure mooring line surface 297 act to compress the mooring line against the aperture 105 that is sized and configured as a passage for the marine mooring line (not shown).

Figure 12:
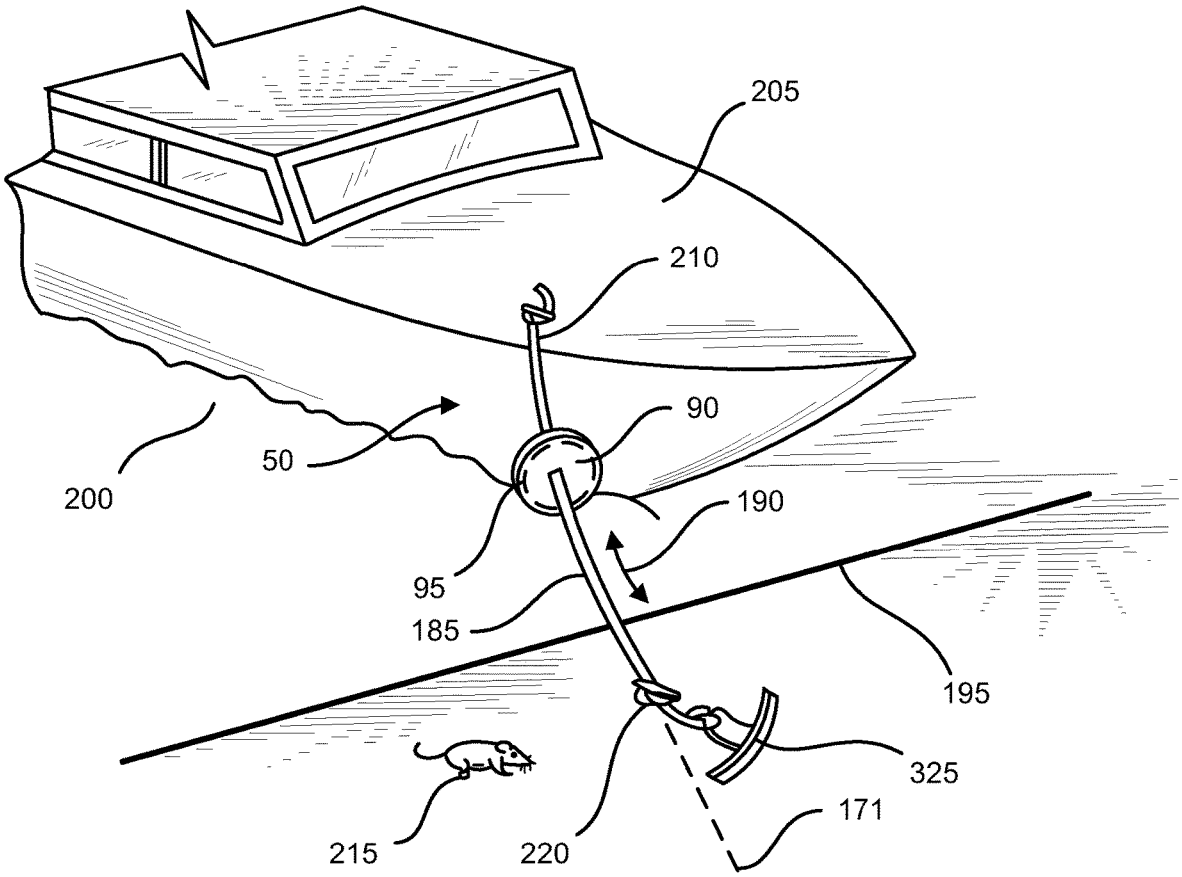
FIG. 12 shows the marine mooring line vermin shield assembly in use placed on a marine mooring line that secures the pleasure craft to the shoreline.

As an identification for the mooring vermin shield 50 the pleasure craft registration number can be added to the disc face 90 in the area shown by 95 to associate the vermin shield 50 to the pleasure craft 205, which is shown in FIG. 12. Also shown is the disc slot opening radial axis 85 and its relation to the second disc closure clearance 150 facing the non pivot end of the closure 60. The disc 55 has a periphery 110 with a closure first end 119 that is substantially flush with the disc periphery 110 when the closure 60 is in the closed state as shown to complete the formation of a nearly solid disc, being the combination of the disc 55 and the closure 60 when the closure 60 is in the closed state. The closure 60 first end 305 also includes an opposing second end 315 that in conjunction with the closure axial guide surface 297 is adapted to partially compress the mooring line against the aperture 105 when the closure 60 is in the closed state, in other words when the aperture insert 230 is not required due to the size of the mooring line.

Figure 5:
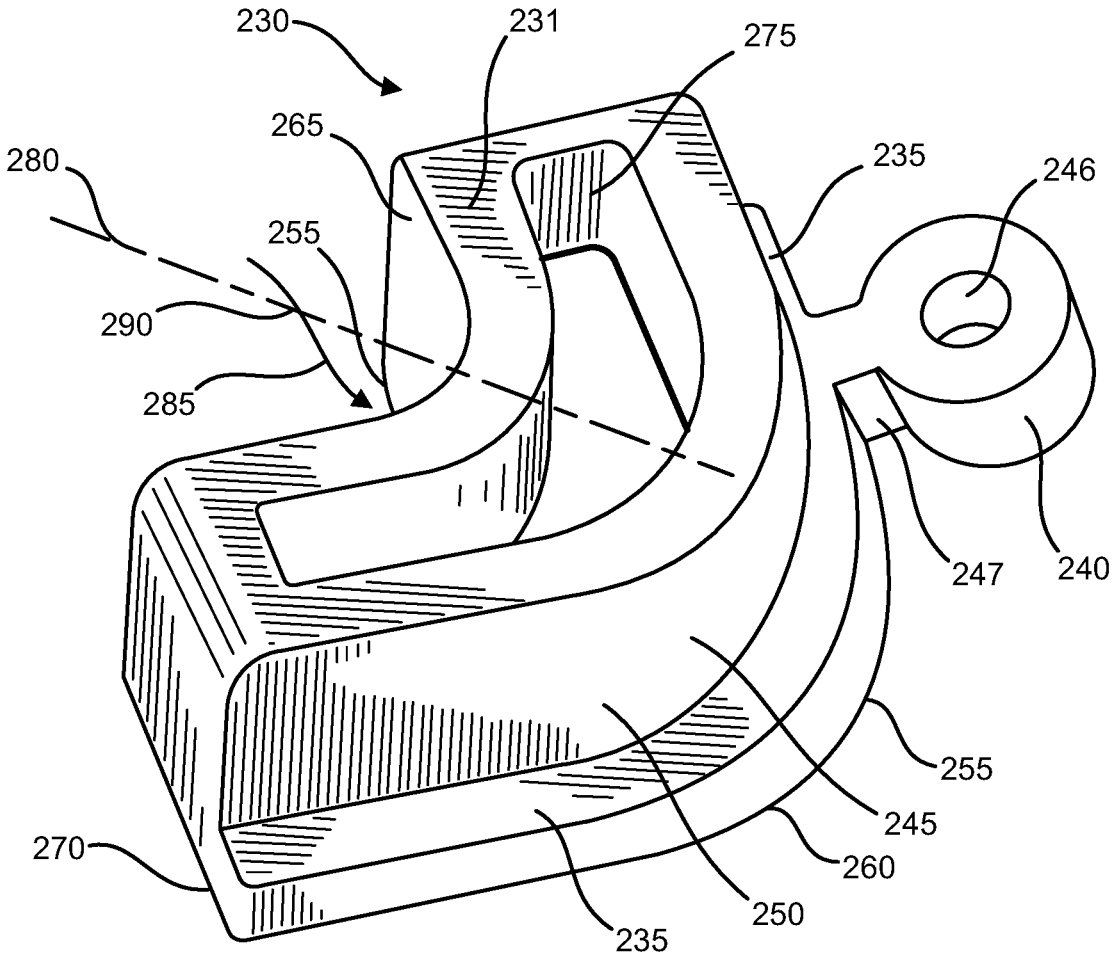
FIG. 5 shows an expanded perspective view of the aperture insert that that is removably engaged to the closure (not shown)
Figure 6:
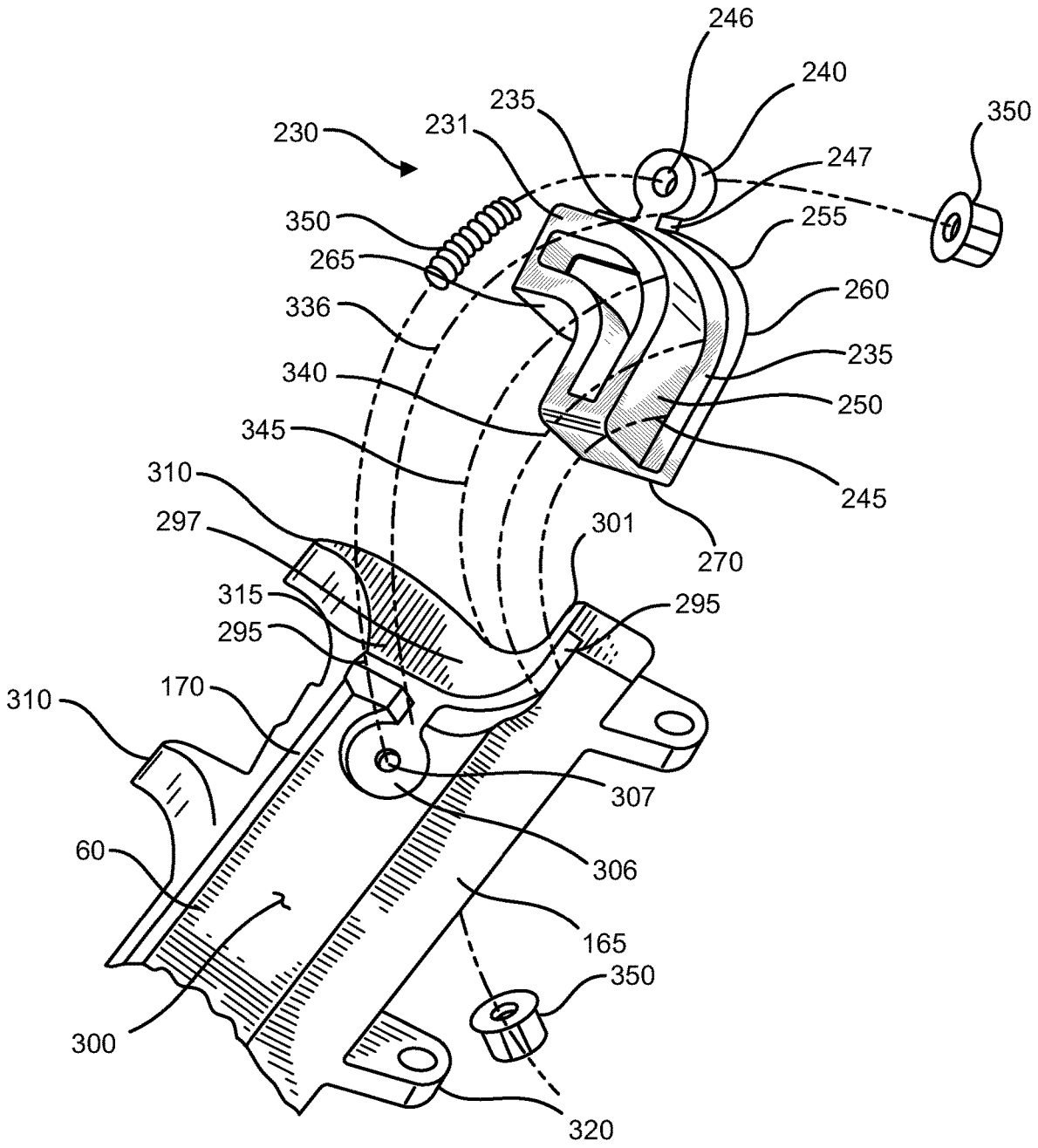
FIG. 6 shows an exploded perspective view of the aperture insert and the closure with lines of demarcation showing the removable engagement elements between the aperture insert and the closure.

Looking more specifically to the aperture insert 230 shown is the protrusion 240 as it is slidably received into the closure void 306 and the aperture retention screw protrusion die clearance 245, see in particular FIG. 6, plus FIG. 5. The aperture insert 230 also has a face 255 that is substantially flush with the disc face 90 when the closure 60 is in the closed state as shown, see FIG. 5, also FIGS. 1 and 7. An aperture insert 230 shoulder 260 forms a minimal clearance gap with the slot opening 80 in the disc 55 when the closure 60 is in the closed state to further complete the formation of a nearly solid disc, being the combination of the disc 55, the closure 60, and with the aperture insert 230 when required when the closure 60 is in the closed state, see FIGS. 1, 6, and 7.

Figure 2:
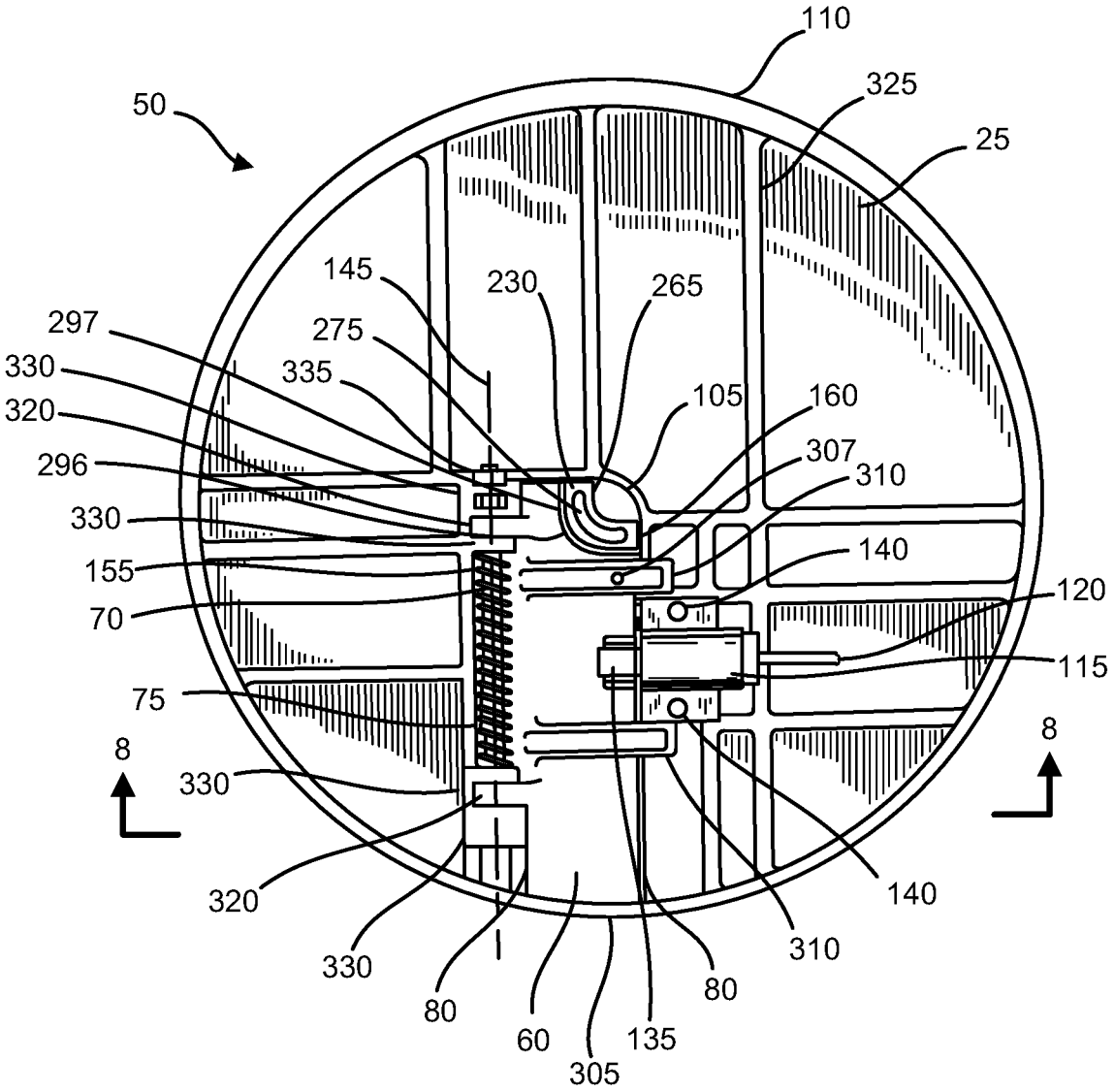
FIG. 2 shows a back or rear view of the marine mooring line vermin shield assembly with the closure including the removable aperture inserted into the disc slot, resulting in the closure being in a closed state secured by a lock.
Figure 8:
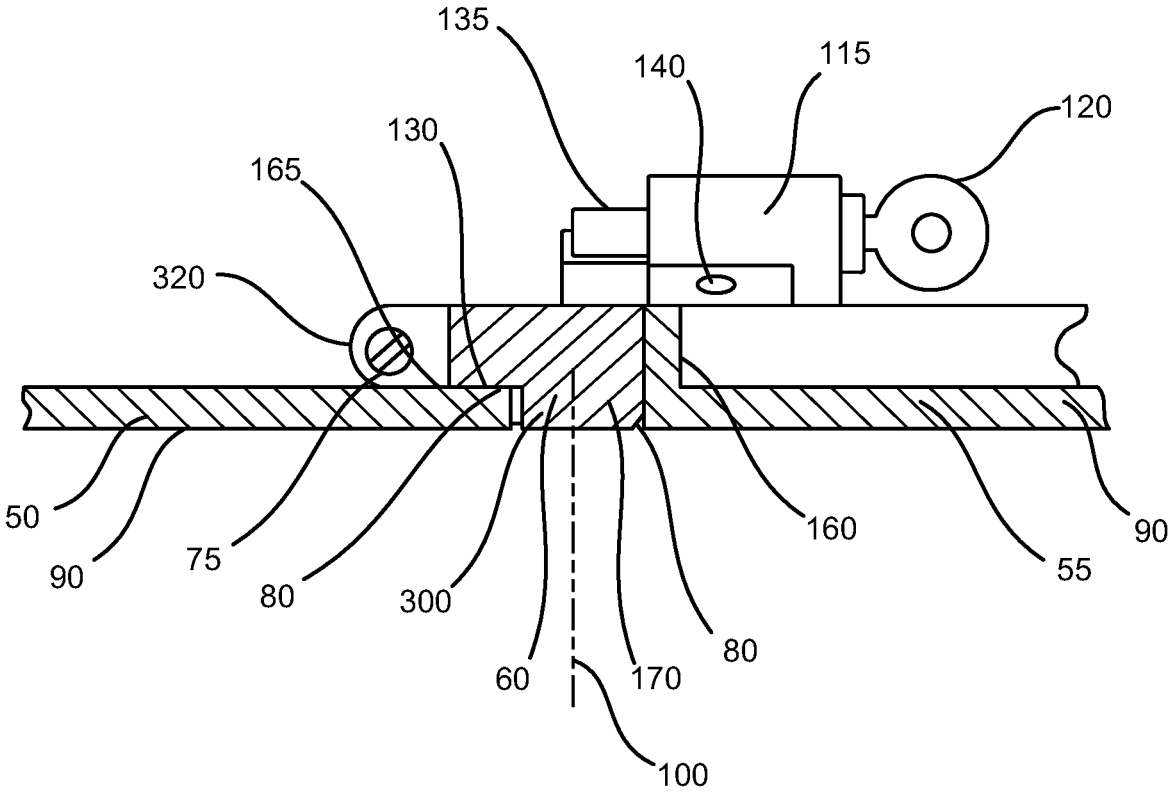
FIG. 8 shows section 8-8 from FIG. 2 of the marine mooring line vermin shield assembly with the closure inserted into the disc slot, resulting in the closure being in a closed state secured by the lock.
Figure 9:
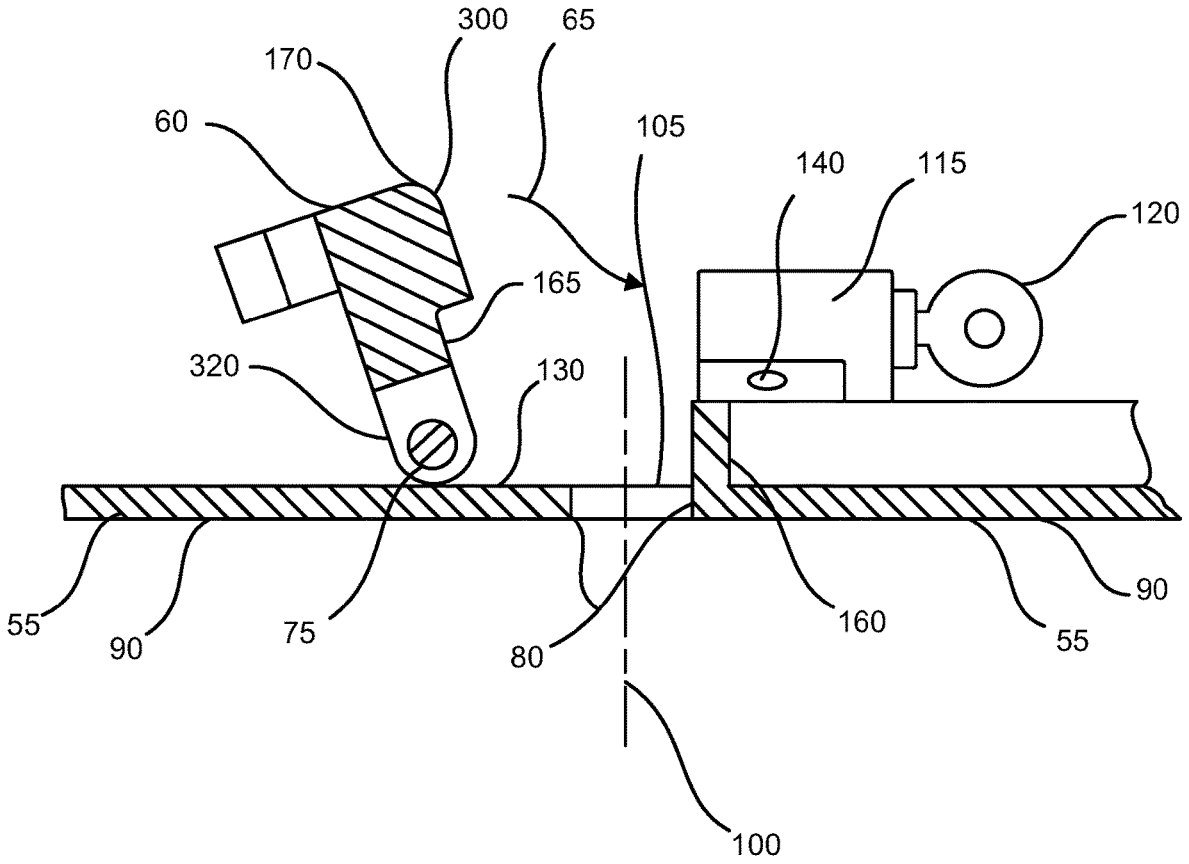
FIG. 9 shows section 9-9 from FIG. 4 of the marine mooring line vermin shield assembly with the closure extracted from the disc slot, resulting in the closure being in an open and unlocked state.

Looking next to FIG. 2, shown is a back or rear view of the marine mooring line vermin shield assembly 50 with the closure 60 and removable aperture 230 slidably engaged into the closure 60 second end 315, with the combination of the closure 60 and the aperture insert 230 inserted into the disc slot 80, resulting in the closure 60 being in a closed state secured by the lock 115. More specifically, the marine mooring line vermin shield assembly 50 is shown in a back view from the side opposite of the substantially flush disc face (not shown) to clearly identify the components of the closure 60, the means 70 for urging the closure 60 from the open state to the closed state, and the lock 115 with the locked extension 135 being extended to secure the closure 60 in the closed state. The lock 115 is shown with its key 120 that allows the lock extension 135 to slidably move to lock the closure 60 into the closed state and to allow the closure 60 to be placed into the open state as best shown in FIG. 8 and FIG. 9. The disc 55 as shown assumes a round periphery 110.

Although the disk periphery 110 as shown is round in shape it would be acceptable for the disc periphery 110 to assume a number of different configurations depending upon manufacturing, shipping, and use considerations. The disk periphery 110 could be square, rectangular, elliptical, egg shaped, or a polygon with any number of multiple straight sides. As shown the disc 55 has multiple disc reinforcing rib 325 construction, alternatively the disc 55 could be of a solid non rib construction. Materials of construction for the disk 55 are preferably of a material that is both corrosion resistant in a marine atmosphere and a material that has a mass density less that the mass density of water, to allow the disk 55 to float in water while supporting the additional elements of the closure 60, the aperture insert 230, the means 70 for urging the closure 60 into the closed state, and the lock 40. The preferred materials of construction for the disk 55 include a plastic that is both light in weight, strong, and easily manufactured. These disc 55 materials of construction could include polyethylene, polypropylene, and polyurethane type materials, however, the disk 55 materials would not be limited to the aforementioned plastics as any suitable alternative material for both manufacturing and use of the disk 55 in a marine environment would be acceptable. The materials of construction for the closure 60 and the aperture insert 230 if required could match that of the aforementioned disc 55. Also shown is the aperture 105 of the disc 55 that is a partially circular opening that utilizes the disc axial axis (not shown) as a centerline. The opening formed by the disk 55 aperture 105 is tangential to one side of slot 80.

The closure 60 as shown is in the closed state by being inserted into the slot 80 as urged by the means 70 for urging the closure 60 from the open state to the closed state. A mooring line passageway is formed by the disc aperture 105 and the aperture mooring line surface 265 of the aperture insert 230 or the closure mooring line surface 297, or as shown, if the aperture insert 230 is required depending upon the mooring line size as will be shown in FIG. 10 and FIG. 11. In other words, either the aperture mooring line surface 265 or as required for mooring line size the closure mooring line surface 297 act to compress the mooring line (not shown) against the aperture 105.

The means 70 for urging the closure 60 from the open state into the closed state can be accomplished by any number of different elements. Preferably a spring element 155 positioned around the rod 75 outside diameter engaging the disc 55 on one end and the closure 60 on the other end is operational to accomplish the means 70 for urging the closure 60 from the open state into the closed state. Alternatively, a torsion rod, or an elastomeric element, could be used to function as the means 70 for urging the closure 60 from the open state into the closed state while meeting the functional requirements and for operation in a marine environment. Preferably, as shown a hinge pivot bolt rod 75 having a pivotal axis 145 is mounted through disc pivot mounts 330 integral to the disc 55 and closure pivot mounts 320 integral to the closure 60 is utilized as shown. Lock fasteners 140 are shown for securing the lock 115 to the disc 55.

These fasteners 140 for the lock 115 can be constructed of preferably stainless steel screws from materials being acceptable for a marine environment. Alternatively, rivets, bolts, or adhesive would be acceptable for the fasteners 140 as long as the operational requirements were met of having adequate attachment strength and suitability for a marine environment to secure the lock 115 to the disc 55. The rod 75 also includes a hinge pivot retention nut 335 that can be self locking to hold the rod 75 within the disc pivot mounts 330 and a spring element 155 to bias or urge the closure 60 to pivot into the closed state as shown. The function of the nut 335 could also be accomplished by swaging the rod 75 end, crimping a sleeve, having a shrink fit collar or any other element known in the art. The materials of construction of the rod 75 and the nut 335 are preferably stainless steel or from other materials being acceptable for a marine environment.

The closure 60 has a pair of finger pulls 310 to ease the manual operation of pivoting the closure 60 from the closed state to the open state. The disc 55 has a periphery 110 with a closure first end 305 that is substantially flush with the disc periphery 110 when the closure 60 is in the closed state as shown to complete the formation of a nearly solid disc, being the combination of the disc 55 and the closure 60 when the closure 60 is in the closed state. The closure 60 first end 305 also includes an opposing second end 315 that in conjunction with the closure axial guide surface 297 is adapted to partially compress the mooring line (not shown) against the aperture 105 when the closure is in the closed state, in other words when the aperture insert 230 is not required due to the size of the mooring line. Looking more specifically to the aperture insert 230 and the slidable engagement of the aperture insert 230 with the closure 60 second end 315, shown is a closure void 296 that is formed with the aperture insert 230 surface 250 when the aperture insert 230 in assembled into the closure 60, further the aperture retention snap protrusion 240 is received by void 306, and the second disc closure clearance 160 that is substantially consistent and minimized between the aperture insert 230 to the disc slot 80 and the closure 60 to the disc slot 80 when the closure 60 is in the closed state. Also shown is an aperture void 275 which is optional depending upon the size of aperture insert 230 required based upon mooring line size.

Figure 3:
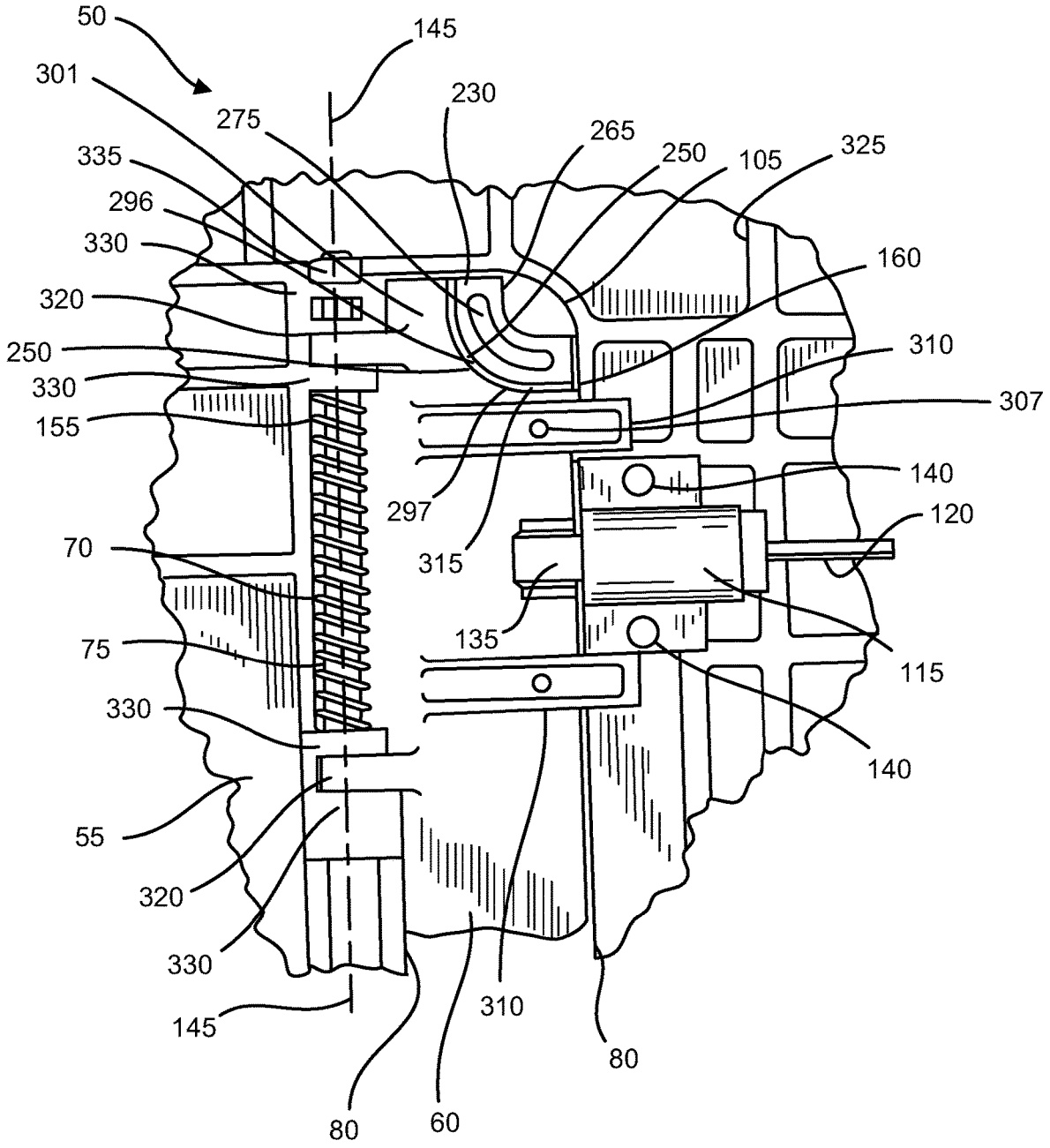
FIG. 3 shows an expanded back or rearview of the marine mooring line vermin shield assembly with the closure including the removable aperture inserted into the disc slot, resulting in the closure being in a closed state secured by the lock.

Further looking to FIG. 3 shown is an expanded back or rear view of the marine mooring line vermin shield assembly 50 with the closure 60 and removable aperture 230 slidably engaged into the closure 60 second end 315, with the combination of the closure 60 and the aperture insert 230 inserted into the disc slot 80, resulting in the closure 60 being in a closed state secured by the lock 115. More specifically, the marine mooring line vermin shield assembly 50 is shown in a back view from the side opposite of the substantially flush disc face (not shown) to clearly identify the components of the closure 60, the means 70 for urging the closure 60 from the open state to the closed state, and the lock 115 with the locked extension 135 being extended to secure the closure 60 in the closed state. The lock 115 is shown with its key 120 that allows the lock extension 135 to slidably move to lock the closure 60 into the closed state and to allow the closure 60 to be placed into the open state as best shown in FIG. 8 and FIG. 9. As shown the disc 55 has multiple disc reinforcing rib 325 construction, alternatively the disc 55 could be of a solid non rib construction. Also shown is the aperture 105 of the disc 55 that is a partially circular opening that utilizes the disc axial axis (not shown)

as a centerline. The opening formed by the disk 55 aperture 105 is tangential to one side of slot 80.

The closure 60 as shown is in the closed state by being inserted into the slot 80 as urged by the means 70 for urging the closure 60 from the open state to the closed state. A mooring line passageway is formed by the disc aperture 104 and the aperture mooring line surface 265 of the aperture insert 230 or the closure mooring line surface 297, or as shown, if the aperture insert 230 is required depending upon the mooring line size as will be shown in FIG. 10 and FIG. 11. In other words, either the aperture mooring line surface 265 or as required for mooring line size the closure mooring line surface 297 act to compress the mooring line (not shown) against the aperture 105.

The means 70 for urging the closure 60 from the open state into the closed state can be accomplished by any number of different methods. Preferably a spring element 155 positioned around the rod 75 outside diameter engaging the disc 55 on one end and the closure 60 on the other end is operational to accomplish the means 70 for urging the closure 60 from the open state into the closed state. Alternatively, a torsion rod, or an elastomeric element, could be used to function as the means 70 for urging the closure 60 from the open state into the closed state while meeting the functional requirements and for operation in a marine environment. Preferably, as shown a hinge pivot bolt rod 75 having a pivotal axis 145 is mounted through disc pivot mounts 330 integral to the disc 55 and closure pivot mounts 320 integral to the closure 60 as shown. Lock fasteners 140 are shown for securing the lock 115 to the disc 55. These fasteners 140 for the lock 115 can be constructed of preferably stainless steel screws from materials being acceptable for a marine environment. Alternatively, rivets, bolts, or adhesive would be acceptable for the fasteners 140 as long as the operational requirements were met of having adequate attachment strength and suitability for a marine environment to secure the lock 115 to the disc 55. The rod 75 also includes a hinge pivot retention nut 335 that can be self locking to hold the rod 75 within the disc pivot mounts 330 and a spring element 155 to bias or urge the closure 60 to pivot into the closed state as shown. The function of the nut 335 could also be accomplished by swaging the rod 75 end, crimping a sleeve, having a shrink fit collar or any other element known in the art. The materials of construction of the rod 75 and the nut 335 are preferably stainless steel or from other materials being acceptable for a marine environment.

Figure 7:
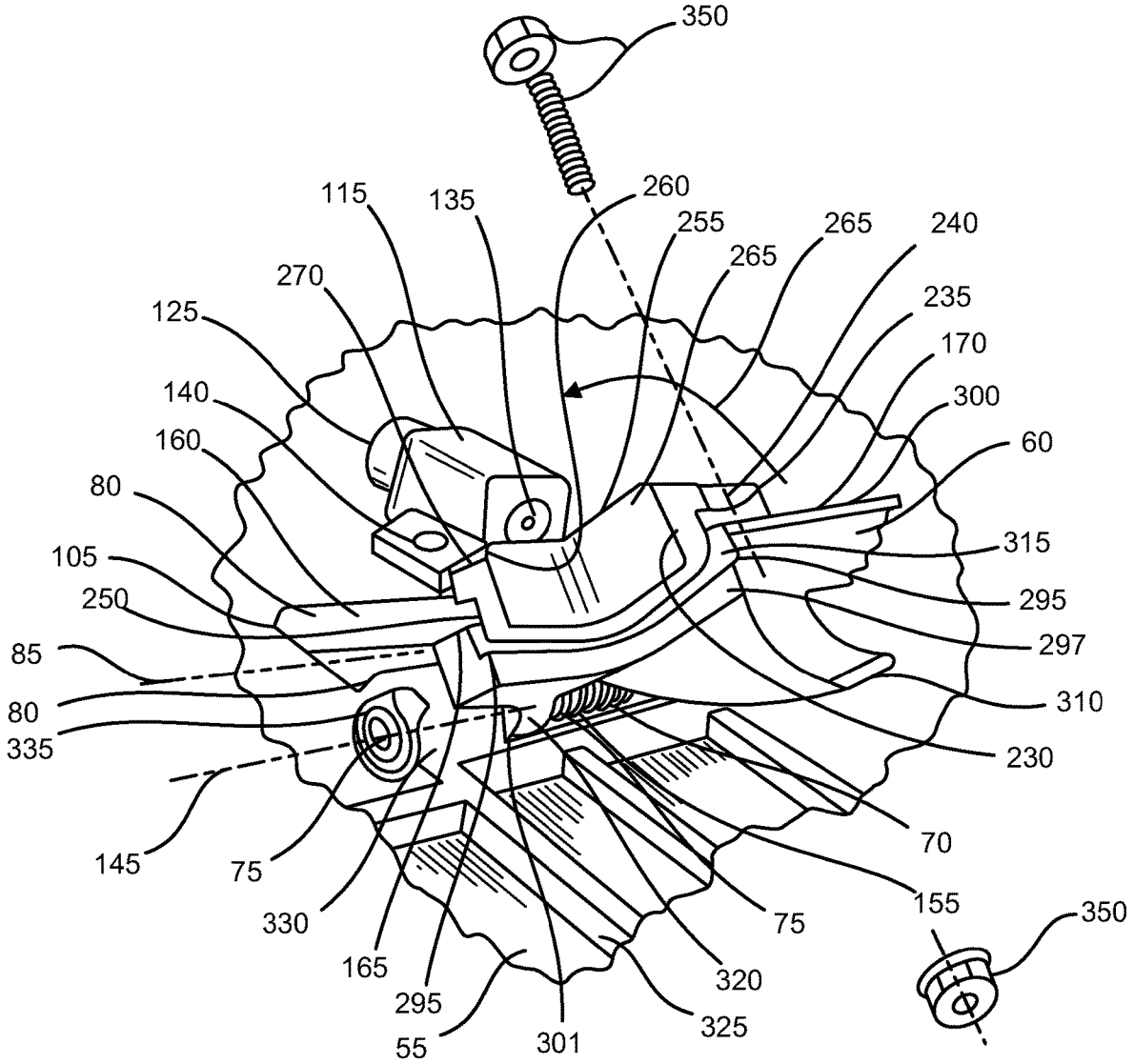
FIG. 7 shows a perspective view of the marine mooring line vermin shield assembly and in particular the closure extracted from the disc slot in an unlocked and open state, with the aperture insert partially engaged with the closure.

The closure 60 has a pair of finger pulls 310 to ease the manual operation of pivoting the closure 60 from the closed state to the open state. The closure 60 second end 315 that in conjunction with the closure axial guide surface 297 is adapted to partially compress the mooring line (not shown) against the aperture 105 when the closure is in the closed state, in other words when the aperture insert 230 is not required due to the size of the mooring line 185. Looking more specifically to the aperture insert 230 and the slidable engagement of the aperture insert 230 with the closure 60 second end 315 shown is a closure void 296 that removably interlocks with an aperture retention snap protrusion 240, and the second disc closure clearance 160 that is substantially consistent and minimized between the aperture insert 230 to the disc slot 80 and the closure 60 to the disc slot 80 when the closure 60 is in the closed state. Also shown is an aperture void 275 which is optional depending upon the size of aperture insert 230 required based upon mooring line 185 size. The aperture axial guide surface 250 slidably contacts the closure axial guide surface 297 when the aperture insert 230 is required, as is best shown in FIG. 7.

Moving next to FIG. 4 shown is a perspective view of the marine mooring line vermin shield assembly 50 with the closure 60 and the removable aperture 230 extracted from the disc slot 80, resulting in the closure 60 being in an unlocked and open state. More specifically, the marine mooring line vermin shield assembly 50 is shown in a back view from the side opposite of the substantially flush disc face (not shown) to clearly identify the components of the closure 60, the means 70 for urging the closure 60 from the open state to the closed state, and the lock 115 with the locked extension (not shown) being retracted to allow the closure 60 to be placed in the open state as shown. The lock 115 is shown with its key 135 hole 125 extended outward that allows the lock extension to retract to have the lock 115 be in the unlocked state, and allow the closure 60 into the open state as best shown in FIG. 9. The lock 115 is preferably constructed of corrosion resistant material suitable for a marine environment. The lock 115 as shown with the key hole 125 is preferably a Prime-Line model number U-9862 available from Prime-Line, of San Bernardino, Calif. 92407, or other suitable alternative. As shown, the disc 55 has multiple disc reinforcing rib 325 construction, alternatively the disc 55 could be of a solid non 165 rib construction. Also shown is the aperture 105 of the disc 55 that is a partially circular opening that is coincident to the disc axial axis 100 that is perpendicular to the disc face (not shown) as a centerline for the aperture 105. The disc axial axis 100 is positioned in a central portion of the disc 55. The opening formed by the disk 55 aperture 105 is tangential to one side of slot 80.

The closure 60 as shown is in the open state by being manually extracted from the slot 80 as manually urged using the closure finger pulls 310 against the means 70 for normally urging the closure 60 from the open state to the closed state. A mooring line passageway is formed by the disc aperture 105 and the aperture mooring line surface 265 of the aperture insert 230 or the closure mooring line surface 297, or as shown, if the aperture insert 230 is required depending upon the mooring line size as will be shown in FIG. 10 and FIG. 11. In other words, either the aperture mooring line surface 265 or as required for mooring line size the closure mooring line surface 297 act to compress the mooring line (not shown) against the aperture 105.

The means 70 for urging the closure 60 from the open state into the closed state can be accomplished by any number of different methods. Preferably a spring element 155 positioned around the rod 75 outside diameter engaging the disc 55 on one end and the closure 60 on the other end is operational to accomplish the means 70 for urging the closure 60 from the open state into the closed state. Alternatively, a torsion rod, or an elastomeric element, could be used to function as the means 70 for urging the closure 60 from the open state into the closed state while meeting the functional requirements and for operation in a marine environment. Preferably, as shown a hinge pivot bolt rod 75 having a pivotal axis 145 is mounted through disc pivot mounts 335 integral to the disc 55 and closure pivot mounts 320 integral to the closure 60 as shown. Thus, the means 70 for urging the closure 60, being the rod 75 and spring 155 positioned on the rod 75 outside diameter is pivotally oriented along the pivotal axis 145 substantially parallel to the slot axis 85. The rod 75 and spring 155 can be constructed of preferably stainless steel or from other materials being acceptable being corrosion resistant for a marine environment. Lock fasteners 140 are shown for securing the lock 115 to the disc 55. These fasteners 140 for the lock 115 can be constructed of preferably stainless steel screws from materials being acceptable for a marine environment. Alternatively, rivets, bolts, or adhesive would be acceptable for the fasteners 140 as long as the operational requirements were met of having adequate attachment strength and suitability for a marine environment to secure the lock 115 to the disc 55. The rod 75 also includes a hinge pivot retention nut 335 that can be self locking to hold the rod 75 within the disc pivot mounts 330 and a spring element 155 to bias or urge the closure 60 to pivot into the closed state as shown. The function of the nut 335 could also be accomplished by swaging the rod 75 end, crimping a sleeve, having a shrink fit collar or any other element known in the art. The materials of construction of the nut 335 are preferably stainless steel or from other materials being acceptable for a marine environment.

The closure 60 has a pair of finger pulls 310 to ease the manual operation of pivoting the closure 60 from the closed state to the open state as shown. The closure 60 second end 315 that in conjunction with the closure axial guide surface 296 is adapted to partially compress the mooring line (not shown) against the aperture 105 when the closure is in the closed state, in other words when the aperture insert 230 is not required due to the size of the mooring line. Looking more specifically to the aperture insert 230 shown is the aperture retention screw 350 protrusion 240 as it is slidably received into the closure receiving void 306 (shown in FIG. 6) and the aperture retention protrusion die clearance 245. The aperture insert 230 also has a face 255 that is substantially flush with the disc face (not shown) when the closure 60 is in the closed state. An aperture insert 230 shoulder 260 forms a minimal clearance gap with the slot opening 80 in the disc 55 when the closure 60 is in the closed state to further complete the formation of a nearly solid disc, being the combination of the disc 55, the closure 60, and with the aperture insert 230 when required when the closure 60 is in the closed state.

On the closure 60 itself, shown is the closure face 300 that is substantially flush with both the disc face (not shown) and the aperture insert face 255 when the closure 60 is in the closed state within the disc slot 80 along the slot opening radial axis 85 in the disc 55. Also adjacent to the aperture insert face 255 is the aperture shoulder 260 and an aperture face recess 270 rests against the disc closure rest 130 in conjunction with the first closure rest 165. The first closure rest 165 in contacting the disc closure rest 130 acts as a gage stop to limit the means 70 for urging the closure 60 from the open state to the closed state, in effect setting the closed state position of the closure 60 in relation to the disc 55. The disc closure rest 130 is adjacent to a first disc closure clearance 150 that marks the transition from the disc closure rest 150 to the disc reinforcing ribs 325 and the disc pivot mounts 330. As the closure 60 moves from the open state to the closed state and vice versa, the closure 60 travels through the closure pivotal movement arc 65 as best shown in FIGS. 8 and 9.

The closure 60 is sized and adapted to insert into the slot 80 in a closure 60 pivotal movement arc 65 approximately parallel to the disc axial axis 100. The closure 60 is in a closed state when inserted into the slot 80 and us substantially flush on a portion of the closure face 300 with the disc face (not shown). The closure 60 is also sized and adapted to manually extract from the slot 80 in the closure pivotal movement arc 65 approximately parallel to the disc axial axis 100, with the closure 60 being in the open state when extracted from the slot 80 to allow the marine mooring line 185 to pass through the slot 80 from the periphery 110 to the aperture 105. The closure 60 including a first end 305 substantially flush with the disc periphery 110, see FIG. 1, when the closure 60 is in the closed state. The closure including an opposing second end 315 is adapted to partially compress the mooring line 185 against the aperture 105 if the aperture insert 230 is not required due to mooring line 185 size when the closure 60 is in the closed state. This results in the disc 55 resisting axial movement 190 along the mooring line 185 when the closure 60 is in the closed state with the disc face 90 generally perpendicular to the mooring line 185 axial axis 180, as best shown in FIG. 12.

Further to FIG. 5 shown in an expanded perspective view of the aperture insert 230 that is removably engaged to the closure 60 as best shown in FIG. 6. Thus in FIG. 6 shown is an exploded perspective view of the aperture insert 230 and the closure 60 with lines of demarcation, identified as reference numbers 336, 340, and 345 as subsequently described in detail, as depicting the removable engagement between the aperture insert 230 and the closure 60, or more specifically the closure second end 315. Also, as FIG. 6 shows the aperture retention screw protrusion 240 being received via the lines of demarcation 340, 345, 336 to the receiving void 306 and further with the aperture axial guide surface 250 piloting to the closure axial guide surface 297 and utilizing the aperture shoulder rest 235 to contact the closure shoulder stop 295 to provide an axial stop (along the axial axis 100) as between the closure 60 and the aperture insert 230, see FIGS. 6 and 7. For retention as between the closure 60 and the aperture insert 230, the fastener 350 is disposed therethrough the aperture 246 using the fastener nut 350 with the fastener 350 also disposed therethrough the second aperture 307 that can use another fastener nut 350, shown in an exploded view in FIG. 6 and assembled in FIG. 7, plus see FIGS. 1, 2, 3, 4, and 10.

Figure 10:
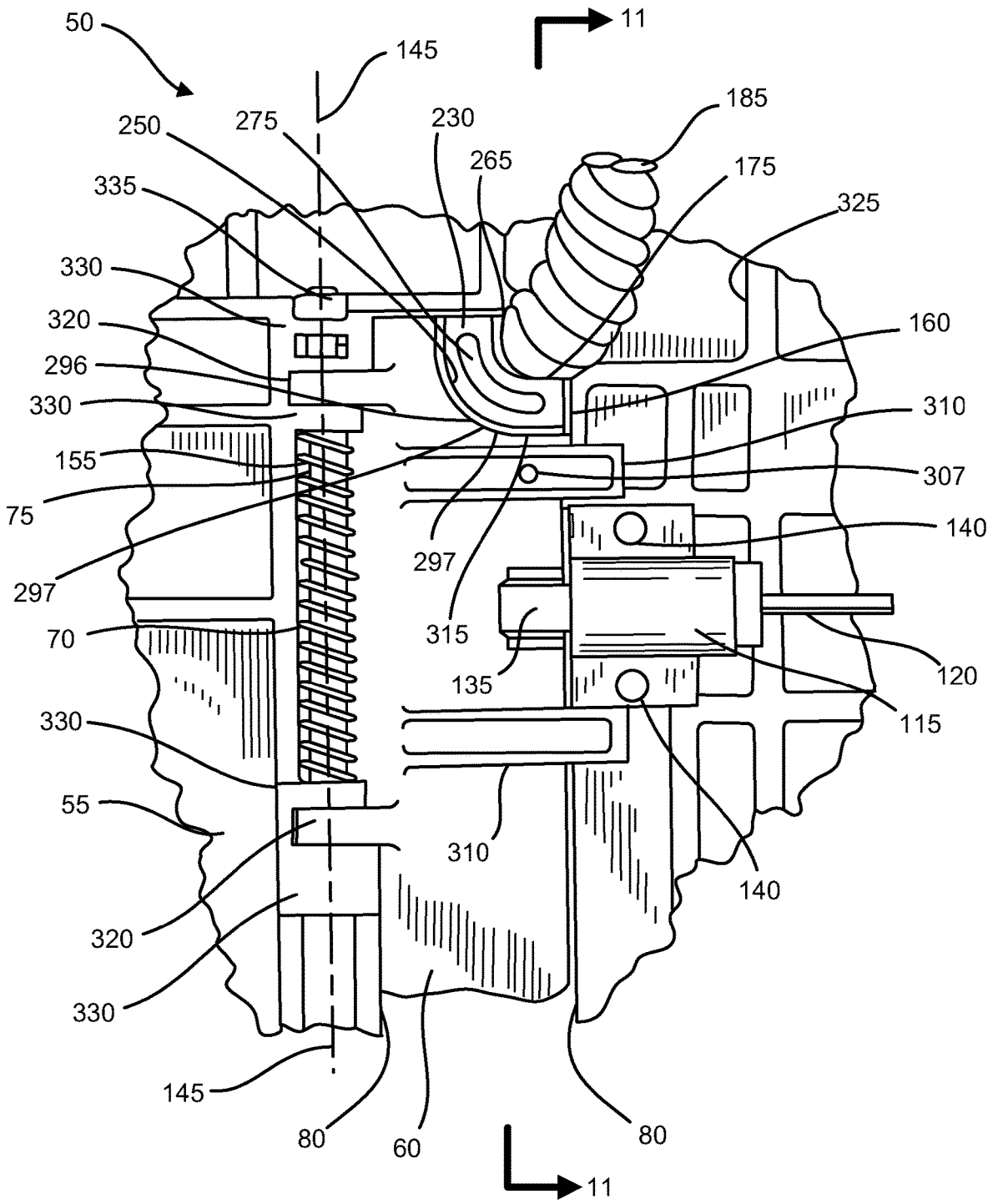
FIG. 10 shows an expanded back or rear view of the marine mooring line vermin shield assembly with the closure and the aperture insert both inserted into the disc slot, resulting in the closure being in a closed state secured by the lock and the marine mooring line compressed between the disc aperture and the aperture insert.
Figure 11:
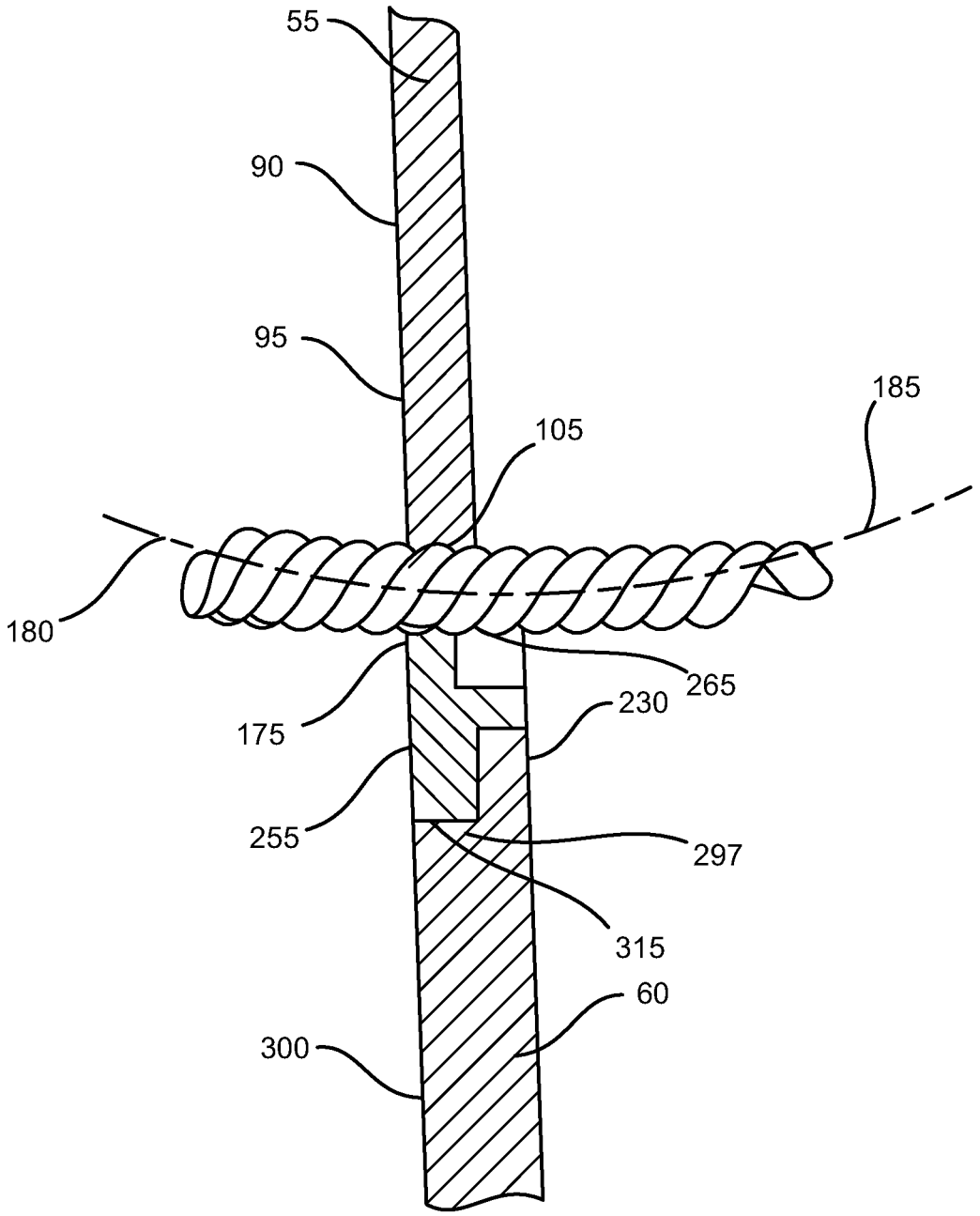
FIG. 11 shows section 11-11 from FIG. 10 of the marine mooring line vermin shield assembly with the closure and aperture insert inserted into the disc slot, resulting in the closure being in a closed state, the marine mooring line being compressed between the disc aperture and the aperture insert.

Further, the aperture insert 230 includes an aperture axial guide surface 250 that has a slidable interface with the closure second end 315 (as best shown in FIG. 7). As the purpose of the aperture insert 230 is to accommodate different sizes of mooring lines 185, specifically relating to the mooring line diameter, an aperture mooring line surface radius 285 of varying dimension or length is utilized to accommodate the different diameters of mooring lines 185. This radius 285 defines the aperture mooring line 185 surface 265 which in effect compresses the mooring line against the disc aperture (as best shown in FIG. 10 and FIG. 11). The radius 285 originates from an aperture mooring line surface radius axis 280 that is in a central portion of the aperture insert 230, wherein the radius 285 intersects the radius axis 280 at an aperture mooring line 185 surface radius intersection 290. Note, that as the radius 285 changes in length for different mooring line diameters the intersection point 290 moves along the radius axis 280 to maintain a more circular aperture in the marine mooring line vermin shield assembly 50 from the combination of the disc aperture 105 and the aperture insert 230. In other words, as the disc aperture 105 is fixed (see FIG. 1 element 105) in configuration curvature, as the radius 285 becomes longer, the intersection point 290 preferably shifts toward the aperture mooring line surface 265 to have a more symmetrically circular aperture in the marine mooring line vermin shield assembly 50 from the combination of the disc aperture 105 the aperture insert 230. If the intersection 285 did not shift in the aforementioned manner the aperture 105 would appear somewhat quarter circular on shape causing a somewhat uneven compression of the mooring line in the marine mooring line vermin shield assembly 50 from the combination of the disc aperture 105 and the aperture insert 230.

Preferably, mooring line diameters accommodated are ½ inch, ⅝ inch, ¾ inch, ⅞ inch, and 1 inch, however, sizes either larger or smaller that the aforementioned could be easily accommodated by the present invention. Note that, on the largest size of mooring line diameter no aperture insert 230 would be used as the closure second end 315 alone would act to compress the mooring line 185, with smaller sizes of mooring line 185 using different aperture inserts 230 that each have a different length radius 285 with a preferably shifting intersection point 290 as previously discussed. Another manufacturing convenience is the aperture void 275 being utilized for the smaller radius 285 aperture inserts 230. The marine mooring line vermin shield assembly 50 would typically include a plurality of aperture inserts 230 allowing a single marine mooring line vermin shield assembly 50 to accommodate various mooring line 185 sizes.

Moving next to detail on the closure 60 a pair of finger pulls 310 is operational to ease the manual operation of pivoting the closure 60 from the closed state to the open state (as shown in FIG. 4 and FIG. 7). The closure 60 second end 315 that in conjunction with the closure axial guide surface 297 is adapted to partially compress the mooring line 185 (not shown) against the aperture 105 (not shown) when the closure 60 is in the closed state, in other words when the aperture insert 230 is not required due to the size of the mooring line 185. On the closure 60 itself, shown is the closure face 300 that is substantially flush with both the disc face 90 (not shown) and the removably engaged (shown as separated) aperture insert face 255 when the closure 60 is in the closed state within the disc slot 80 (not shown). The first closure rest 165 contacts the disc closure rest 130 (not shown) that acts as a gage stop to limit the closure 60 positioning within the disc 55 (not shown). As the closure 60 moves from the open state to the closed state and vice versa, the closure travels through the closure pivotal movement arc 65 (not shown), requiring that a closure clearance taper 170 be on the closure 60 to clear the slot opening 85 (not shown) in the disc 55 when the closure 60 travels through the closure pivotal movement arc 65 as best shown in FIG. 8 and FIG. 9. Also shown on the closure 60 are the closure pivot mounts 320 as best functionally shown in FIG. 4.

Moving next to FIG. 7 shown is a perspective view of the marine mooring line vermin shield assembly 50 and in particular the closure 60 extracted from the disc slot 80 in an unlocked and open state, with the aperture insert 230 partially engaged with the closure 60 second end 315. More specifically, the marine mooring line vermin shield assembly 50 is shown in a back view from the side opposite of the substantially flush disc face 90 (not shown) to clearly identify the components of the closure 60, the means 70 for urging the closure 60 from the open state to the closed state, and the lock 115 with the locked extension 135 being retracted to allow the closure 60 to be placed in the open state as shown. The lock 115 is shown with its key hole 125 (not shown) extended outward that allows the lock extension 135 to retract to have the lock 115 be in the unlocked state, and allow the closure 60 into the open state as best shown in FIG. 9. As shown, the disc 55 has multiple disc reinforcing rib 325 construction, alternatively the disc 55 could be of a solid non rib construction. Also shown is the aperture 105 of the disc 55 that is a partially circular opening that utilizes the disc axial axis 100 (not shown) as a centerline. The opening formed by the disk 55 aperture 105 is tangential to one side of slot 80.

The closure 60 as shown is in the open state by being manually extracted from the slot 80 as manually urged using the closure finger pulls 310 (only one is shown) against the means 70 for normally urging the closure 60 from the open state to the closed state. A mooring line passageway is formed by the disc aperture 105 and the aperture mooring line surface 265 of the aperture insert 230 or the closure mooring line surface 297, or as shown, if the aperture insert 230 is required depending upon the mooring line size as will be shown in FIG. 10 and FIG. 11. In other words, either the aperture mooring line surface 265 or as required for mooring line size the closure mooring line surface 297 act to compress the mooring line 185 (not shown) against the aperture 105.

The means 70 for urging the closure 60 from the open state into the closed state can be accomplished by any number of different elements. Preferably a spring element 155 positioned around the rod 75 outside diameter engaging the disc 55 on one end and the closure 60 on the other end is operational to accomplish the means 70 for urging the closure 60 from the open state into the closed state. Alternatively, a torsion rod, or an elastomeric element, could be used to function as the means 70 for urging the closure 60 from the open state into the closed state while meeting the needs of a marine environment. Preferably, the hinge pivot bolt rod 75 is mounted through disc pivot mounts 330 in the disc 55 and closure pivot mounts 320 in the closure 60. Lock fasteners 140 secure the lock 115 to the disc 55 wherein the fasteners are preferably constructed of stainless steel bolts however, could also be rivets, adhesive, or any suitable equivalent for marine use. The rod 75 includes the hinge pivot retention nut 335 that can be self locking to hold the rod 75 within the disc pivot mounts with a spring element 155 to urge the closure 60 into the closed state from the open state. The nut 335 could be accomplished by swaging the rod 75 ends, crimping, or having a shrink fit collar with the materials of construction being stainless steel or a suitable equivalent for marine use.

The closure 60 uses finger pulls 310 to pivot the closure 60 through the arc 65 to move the closure 60 from the closed state to the open state, see FIGS. 3, 4, 7, 8, 9, and 10. On the closure 60 shown is the closure face 300 that is substantially flush with the disc face 90 and the aperture insert face 255 when the closure 60 is in the closed state within the disc slot 85. Also adjacent to the aperture inset face 255 is the aperture shoulder 260 wherein the aperture face recess 270 rests against the disc closure rest 130 in conjunction with the closure rest 165. As the closure 60 moves through the arc 65 it requires that the closure clearance taper 170 to clear the slot opening 80 as best shown in FIGS. 8 and 9.

Looking to FIG. 8 shows the closure 60 in the locked state, starting with the disc face 90, note that the closure 60 is sized and adapted to insert into the slot 80 such that the disc face 90 and closure 60 face 300 form a substantially flush surface, as the disc face 90 is what the vermin 215 (not shown) will encounter when crawling up the mooring line 185 (not shown). As the closure 60 is shown in the closed state, the closure 60 is urged into that position by the means 70 (not shown) for urging the closure 60 into the closed state. For the portion that is shown, the means 70 for urging the closure 60 includes the rod 75 and the closure pivot mount 320 with the disc pivot mount 330 removed for clarity. As it is desirable to have the closure 60 face 300 be substantially flush with the disc face 90 of the disk 55 when the closure 60 is in the closed state and to provide a positional stop for the means 70 for urging the closure 60 into the closed state within the disc slot 80, that is substantially symmetric about the disc axial axis 100, there are contacting surfaces between the closure 60 and the disc 55. These are the first closure rest 165 that contacts the disc closure rest 130. There is a gap shown in FIG. 8 between the closure rest 165 and disc rest 130 for pictorial clarity, however, in actuality the aforementioned closure rest 165 and disc rest 130 are in contact and act as a gauge to set the closure 60 positioning within the disc slot 80 in order to form the substantially flush disc face with the closure 60 in the closed state at the disc face 90.

The lock 115 with its key 120 is shown in the locked state with the lock extension 135 extended to prevent the closure 60 from going to the open state, thus helping to prevent theft of the mooring line shield 50 from the mooring line 185, however, noting that the lock 115 is not essential for the mooring line shield 50 to function.

Next in FIG. 9 shown is the closure 60 in the open state with the as it is extracted through the arc 65 along the pivotal axis 145 manually using the finger pulls 310 as against the means for urging 70. The lock 115 with its key 120 is also shown in the unlocked state with the locked extension 135 (not shown) retracted to allow the closure 60 to be manually extracted from the slot 80 into the open state. Fasteners 140 are shown for securing the lock 115 to the disc 55. These fasteners 140 (one fastener is shown) for the lock 115 can be constructed of preferably stainless steel screws from materials being acceptable for a marine environment. Alternatively, rivets, bolts, or adhesive would be acceptable for the fasteners 140 as long as the operational requirements were met of having adequate attachment strength and suitability for a marine environment to secure the lock 115 to the disc 55. Note that the lock 115 could be optional as it is not essential to the function of the marine mooring line vermin shield 50 and acts only to help prevent theft of the marine mooring line vermin shield 50 from the mooring line 185.

Proceeding on to FIG. 10 shown is an expanded back or rear view of the marine mooring line vermin shield assembly 50 with the closure 60 and the aperture insert 230 both inserted into the disc slot 80, resulting in the closure 60 being in a closed state secured by the lock 115 and the marine mooring line 185 compressed 175 between the disc aperture 105 (not shown) and the aperture insert 230. More specifically, the marine mooring line vermin shield assembly 50 is shown in a back view from the side opposite of the substantially flush disc face 90 (not shown) to clearly identify the components of the closure 60, the means 70 for urging the closure 60 from the open state to the closed state, and the lock 115 with the locked extension 135 being extended to secure the closure 60 in the closed state. The lock 115 is shown with its key 120 that allows the lock extension 135 to slidably move to lock the closure 60 into the closed state and to allow the closure 60 to be placed into the open state as best shown in FIG. 8 and FIG. 9. As shown the disc 55 has multiple disc reinforcing rib 325 construction, alternatively the disc 55 could be of a solid non rib construction. Also the aperture 105 of the disc 55 that is a partially circular opening that utilizes the disc axial axis 100 (not shown) as a centerline (as best shown in FIG. 3). The opening formed by the disk 55 aperture is tangential to one side of slot 80.

In FIG. 10, the closure 60 as shown is in the closed state by being inserted into the slot 28 as urged by the means 70 for urging the closure 60 from the open state to the closed state. A mooring line 185 passageway is formed by the disc aperture 105 and the aperture mooring line surface 265 of the aperture insert 230 or the closure mooring line surface 297, (again as best shown in FIG. 3) or as shown, if the aperture insert 230 is required depending upon the mooring line 185 size as will be also shown FIG. 11. In other words, either the aperture mooring line surface 265 or as required for mooring line size the closure mooring line surface 297 act to compress the mooring line 195 against the aperture 105.

Further proceeding on to FIG. 11 shown is section 11-11 from FIG. 10 of the marine mooring line vermin shield 50 assembly with the closure 60 and aperture insert 230 inserted into the disc 55 slot (not shown), resulting in the closure 60 being in a closed state, the marine mooring line 185 being compressed 175 between the disc aperture 105 and the aperture insert 230. The mooring line 195 is shown passing through the passageway formed by the aperture 105 and the aperture mooring line surface 265 of the aperture insert 230 or the closure mooring line surface 297, (again as best shown in FIG. 3) or as shown, if the aperture insert 230 is required depending upon the mooring line 185 diameter. In other words, either the aperture mooring line surface 265 or as required for the mooring line 185 diameter the closure mooring line surface 297 being a portion of the closure second end 315 act to compress the mooring line 185 against the aperture 105. When the closure 60 is in the closed state the aperture insert 230 when properly installed has a face 255 that is substantially flush with both the disc face 90 and the closure face 300.

Thus, with the closure 60 being in the closed state, more particularly, shown is the compression 175 of the mooring line 185 between the aperture 105 and either the aperture insert 230 of the closure mooring line surface 297. This compression of the mooring line 185 occurs at the portion of the mooring line 185 identified as compression 175 with the purpose of securing the mooring line vermin shield assembly 50 from axial movement along the mooring line 185 approximately along the mooring line axial axis 180. In addition, the aforementioned securing compression 175 of the mooring line 185 helps to keep the disk face 90 generally perpendicular to the mooring line axial axis 180, with the purpose being to maximize the difficulty for the vermin crawling along the mooring line 185 to overcome the shield assembly 50 in attempting to gain passage to the pleasure craft 205 on the opposite side of the vermin shield assembly 50 as best shown in FIG. 12. Also shown is the placement area for the pleasure craft registration number being on the same side as the disc face 90. The mooring line 185 which is termed in the art as either nylon anchor line, nylon mooring line, braided nylon anchor line, twisted nylon anchor line, or poly anchor line is preferred as it is required that the mooring line be compressible to some extent. The amount of compression on the mooring line 185 when the closure 60 is in the closed state for the purpose of securing the vermin shield assembly 50 to the mooring line 185 is preferably about one sixteenth of an inch as previously described.

METHOD OF USE

Finally, looking to FIG. 12 shown is the marine mooring line vermin shield assembly 50 in use placed on a marine mooring line 185 that secures the pleasure craft 205 to the shoreline 195 or dock 195. Starting with the pleasure craft 205 which can be a conventional speedboat, water skiing boat, small fishing boat, sailboat, a houseboat, or any other type of smaller marine craft. The pleasure craft 205 is floating in the body of water 200 in close proximity to land, which includes either an undeveloped shoreline 195 or a dock 195 or a marina 195. There is a deck cleat 210 shown on the pleasure craft 205 for attaching the mooring line 185 to the deck of the pleasure craft 205. Normally the other end of the mooring line 195 will either be secured to a dock cleat 220 that is mounted to the dock or marina 195 or in the case where there is no dock or marina an anchor 225 will be used that is attached to the other end of the mooring line 185 that is secured to the shoreline 195 by either burying the anchor 220 along the shoreline or securing the anchor to a rock and the like. Although a singular mooring line 185 is shown for pictorial simplicity, typically a plurality of mooring lines 185 are used to prevent the pleasure craft 205 from swinging in a pendulum type action in relation to the dock or shoreline 195 from either wind or water currents thus potentially causing damage to the pleasure craft 205 from the pleasure craft 205 contacting the dock or shoreline 195. In most cases, two mooring lines 185 are used to secure the pleasure craft 205 from the potentially damaging pendulum swinging motion. For an even larger pleasure craft 205 such as a houseboat, four mooring lines 185 are typically used to secure the pleasure craft 205 from the potentially damaging pendulum swinging motion. Note that, each mooring line 185 requires at least one mooring line vermin shield assembly 50, thus most pleasure craft 205 would require two to four mooring line vermin shield assemblies 50.

The principal purpose of the mooring line vermin shield assembly 50 is to prevent the passage of a vermin 215 from crawling along the mooring line 185 from the dock 195, marina 195, or shoreline 195 and onto the pleasure craft 210. The mooring line vermin shield assembly 50 is provided that includes the disc 55, with the disc aperture 105, and the disc slot 80, also the closure 60, the aperture insert 230, the lock 115, and the means 70 for urging the closure 60 to insert into the slot 80 resulting in the closure 60 being in a closed state as previously described. To install the mooring line vermin shield assembly 50 the closure 60 must be manually extracted from the slot 80, which requires that the means 70 for urging the closure 60 to insert into the slot 80 must be manually overcome to extract the closure 60 from the slot 80 thus opening up the slot 80 into the aperture 105 that is placed at the center of the disc 55 moving the closure 60 from the closed state to the open state. Next, the size or diameter of the mooring line 185 needs to be determined or ascertained. Further a step of engaging the aperture insert 230 into the closure 60 if required based upon the determined size of the mooring line 185 and at this point the mooring line vermin shield assembly 50 is ready to be positioned onto the mooring line 185 such that the mooring line 185 passes through the slot 80 of the disc 55 to rest against the disc aperture 105. It is important to note that the disc face 90 should be positioned on the mooring line 185 to face the dock 195 or shoreline 195 as shown. This is to ensure that the substantially flush disc surface 90 is the barrier that the vermin 215 encounters first while crawling along the mooring line 185 from the dock 195, marine 195, or shoreline 195. The next step would be to allow the means 70 for urging the closure 60 to insert the closure 60 into the slot 80, thus putting the closure 60 in the closed state, wherein at this point the closure 60 will compress the mooring line 185 against the aperture 105 of the disc 55 and securing the mooring line vermin shield assembly 50 against axial movement 190 along a mooring line 185 axial axis 180.

The securing of the mooring line vermin shield assembly 50 to the mooring line 185 accomplishes three basic purposes, the first is to secure the vermin shield assembly 50 from moving along the mooring line 185 in the direction of axial movement along the mooring line 185, as the mooring line 185 is typically inclined as shown, secondly it is important to maintain the disc face 90 generally perpendicular to the mooring line axial axis 180 to maximize the barrier effect against the vermin 215. Thirdly, an optional lock 115 can be used on the mooring line vermin shield assembly 50 to secure the closure 60 in a closed state thus helping prevent theft of the mooring line vermin shield assembly 50. Additionally, it is important to position the mooring line vermin shield assembly 50 axially on the mooring line 185 a sufficient distance from the dock or shoreline 195 such that the vermin 215 cannot jump or leap onto the mooring line 185 that is between the mooring line vermin shield assembly 50 and the pleasure craft 205 thus allowing the vermin 215 to overcome the barrier. It is recommended the mooring line vermin shield assembly 50 be positioned on the mooring line 185 at an axial location approximately one half way between the shoreline anchor 225, dock cleat 220, dock 195, or shoreline 195, and the pleasure craft 205 or the mooring line cleat 210 on the pleasure craft 205. Optionally, an identification for the mooring vermin shield 50 the pleasure craft registration number can be added to the disc face 90 in the area 95 to associate the mooring line vermin shield 50 to the pleasure craft 205.

Optional further steps could include providing the marine mooring line vermin shield assembly 50 with a plurality of aperture inserts 230 to be selected from based upon mooring line 185 size if required. Also, a step could be included of engaging a selected aperture insert 230 into the closure 60 if required based upon the size of the mooring line 185.

Comparing the present invention to the prior art that uses either semi circular halves of the disc that mate together around the mooring line, or gravity swing doors covering a slot in the disc, or a slot with a resilient cover, the present invention is a more positive system for mounting the disc on the mooring line. This is because the urging means 70 secures the disc 55 to the mooring line without the need for fitting together large halves of a vermin guard, and is more secure in preventing vermin from getting around or through the barrier than either a gravity swing door or a resilient slot cover.

Further, the aperture insert 230 has a piloted and secured structure to interface with the closure 60 to accommodate different mooring line 185 sizes.

CONCLUSION

Accordingly, the present invention of a marine mooring line vermin shield has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A marine mooring line vermin shield to prevent the passage of vermin crawling along a marine mooring line from land to a pleasure craft, comprising:

(a) a disc having a disc axial axis perpendicular to a face of said disc, said disc axial axis being positioned in a central portion of said disc, said disc also includes a disc aperture through said disc coincident to said disc axial axis being positioned such that said disc aperture uses said disc axial axis as a centerline, said disc aperture is sized and configured as a passage for the marine mooring line, said disc also includes a radial slot through said disc coincident to said disc axial axis, said radial slot extending from said disc aperture to a periphery of said disc, said radial slot having a radial axis parallel to said radial slot;

(b) a closure sized and adapted to insert into said radial slot in a closure pivotal movement arc approximately parallel to said disc axial axis, said closure is in a closed state when inserted into said radial slot and is substantially flush with said disc face, said closure also sized and adapted to manually extract from said radial slot in said closure pivotal movement arc approximately parallel to said disc axial axis, said closure is in an open state when extracted from said radial slot to allow the marine mooring line to pass through said radial slot from said periphery to said disc aperture, said closure including a first end substantially flush with said disc periphery when said closure is in the closed state, said closure also including an opposing second end, said closure second end is also sized and configured to removably engageably receive a disc aperture insert, said closure second end includes a closure shoulder stop and a closure axial guide surface, further said closure second end includes a closure fastener protrusion receiving void with a closure void second aperture, said disc aperture insert includes an aperture shoulder rest and an aperture axial guide surface, further said disc aperture insert includes an aperture insert retention protrusion and neck including an aperture insert retention protrusion aperture, wherein said closure shoulder stop and said aperture insert shoulder rest contact one another to set position along said disc axial axis and said closure axial guide surface slidably contacts said aperture axial guide surface wherein said closure fastener protrusion receiving void and said aperture insert retention protrusion with neck are removably interlockable to one another via a fastener disposed in said aperture insert retention protrusion aperture and said closure void second aperture in said closure fastener protrusion receiving void, said aperture insert retention protrusion with neck and said closure fastener protrusion receiving void are positionally nested to one another to provide a single positional fit as between said closure and said aperture insert, being operational to removably retain said disc aperture insert on said closure second end to be correctly positioned to have said disc aperture insert to partially compress the mooring line against said disc aperture when said closure is in said closed state, wherein said disc resists axial movement along the mooring line when said closure is in said closed state with said disc face generally perpendicular to a mooring line axial axis; and (c) means for urging said closure from the open state to the closed state.

2. A marine mooring line vermin shield according to claim 1 wherein said disc aperture insert retention protrusion is constructed of a male keyhole shaped structure and said closure fastener protrusion receiving void is constructed of a female keyhole shaped structure to better facilitate said single positional fit.

3. A marine mooring line vermin shield according to claim 2 wherein said disc aperture insert retention protrusion aperture is disposed substantially central to said male keyhole shape and said closure fastener protrusion receiving void closure void second aperture is disposed substantially central to said female keyhole shape, wherein said disc aperture insert retention protrusion aperture and said closure fastener protrusion receiving void closure void second aperture are aligned to one another when said aperture insert is fitted into said closure to accommodate said fastener.

4. A marine mooring line vermin shield according to claim 1 further comprising a plurality of disc aperture inserts that each have a different disc aperture mooring line surface radius, wherein each said disc aperture insert is operational to accommodate a different size of mooring line.

5. A marine mooring line vermin shield according to claim 1 further comprising a lock to secure said closure in said closed state.

6. A marine mooring line vermin shield according to claim 1 wherein said disc face is a smooth substantially continuous surface with the exception of the marine mooring line protruding therefrom, when said closure is in said closed state, wherein the vermin encounters said disc face while crawling along the mooring line to help prevent passage of the vermin beyond said disc face.

7. A marine mooring line vermin shield according to claim 1 wherein said disc face has an area for placement of a pleasure craft registration number.

8. A marine mooring line vermin shield according to claim 1 wherein said means for urging said closure is pivotally oriented substantially parallel to said radial slot radial axis.

9. A marine mooring line vermin shield according to claim 8 wherein said means for urging said closure further comprises a rod with a pivotal axis that is oriented substantially parallel to said radial slot radial axis.

10. A marine mooring line vermin shield according to claim 9 wherein said means for urging said closure further comprises a spring element disposed about said rod.

11. A method of using a marine mooring line vermin shield to prevent the passage of vermin crawling along a marine mooring line from land to a pleasure craft, comprising the steps of:

(a) providing a marine mooring line vermin shield that includes a disc, with a disc aperture, and a radial slot, a closure including a first end substantially flush with a disc periphery when said closure is in a closed state, said closure also including an opposing second end, said closure second end is also sized and configured to removably engageably receive a disc aperture insert, said closure second end includes a closure shoulder stop and a closure axial guide surface, further said closure second end includes a closure fastener protrusion receiving void with a closure void second aperture, said disc aperture insert includes an aperture shoulder rest and an aperture axial guide surface, further said disc aperture insert includes an aperture insert retention protrusion and neck including an aperture insert retention protrusion aperture, wherein said closure shoulder stop and said aperture shoulder rest contact one another to set position along a disc axial axis and said closure axial guide surface slidably contacts said aperture axial guide surface, wherein said closure fastener protrusion receiving void and said aperture insert retention protrusion with neck are removably interlockable to one another via a fastener disposed in said aperture insert retention protrusion aperture and said closure void second aperture in said closure fastener protrusion receiving void, said aperture insert retention protrusion and said closure fastener protrusion receiving void are positionally nested to one another to provide a single positional fit as between said closure and said disc aperture insert, further included is a lock, and a means for urging said closure to insert into said radial slot resulting in said closure being in a closed state, further providing a plurality of said disc aperture inserts that each have a different disc aperture mooring line surface radius, wherein each said disc aperture insert is operational to accommodate a different size of mooring line;

(b) extracting said closure from said radial slot to place said closure in an open state by manually overcoming said means for urging;

(c) ascertaining a size of the mooring line;

(d) engaging a selected one of said plurality of disc aperture inserts into said closure based upon the size of the mooring line, said engaging requires a positional fit up as between said aperture insert retention protrusion and said closure fastener protrusion receiving void that are to be positionally nested to one another to provide a single positional fit as between said closure and said disc aperture insert, being operational to removably retain said disc aperture insert on said closure second end to be correctly positioned;

(e) attaching said fastener to be disposed in said aperture insert retention protrusion aperture and said closure fastener protrusion receiving void closure void second aperture to secure said disc aperture insert to said closure second end;

(f) positioning said radial slot to allow the marine mooring line to pass through said radial slot to rest against said disc aperture such that said disc is positioned so that a substantially flush disc face faces the land; and (g) allowing said means for urging said closure to insert said closure into said radial slot placing said closure into said closed state, wherein said closure compresses the marine mooring line against said disc aperture to secure said marine mooring line against axial movement on the marine mooting line.

12. A method of using a marine mooring line vermin shield according to claim 11 further comprising a step of locking said closure in said closed state after step (g).

13. A method of using a marine mooring line vermin shield according to claim 11 wherein said step of positioning includes an axial positioning of said disc aperture on the mooring line at an axial axis mooring line approximate midpoint between a mooring line cleat on the pleasure craft and a dock cleat.

14. A method of using a marine mooring line vermin shield according to claim 11 wherein said step of positioning includes an axial positioning of said disc aperture on the mooring line at an axial axis mooring line approximate midpoint between a mooring line cleat on the pleasure craft and an anchor on a shoreline.

* * * * *